US006626770B2

(12) United States Patent
Takemura et al.

(10) Patent No.: US 6,626,770 B2
(45) **Date of Patent: *Sep. 30, 2003**

(54) MULTI-PIECE SOLID GOLF BALL

(75) Inventors: Kohei Takemura, Kobe (JP); Masatoshi Yokota, Kobe (JP); Seigou Sakagami, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 2 days.

This patent is subject to a terminal disclaimer.

(21) Appl. No.: 09/729,690

(22) Filed: Dec. 6, 2000

(65) Prior Publication Data

US 2001/0011045 A1 Aug. 2, 2001

(30) Foreign Application Priority Data

Dec. 6, 1999 (JP) ..... 11-346199

(51) Int. Cl.[7] ..... A63B 37/04
(52) U.S. Cl. ..... 473/371; 473/373; 473/376
(58) Field of Search ..... 473/371, 376, 473/374, 373, 372, 377, 378

(56) References Cited

U.S. PATENT DOCUMENTS

| | | | | |
|---|---|---|---|---|
| 5,253,871 A | | 10/1993 | Viollaz | |
| 5,439,227 A | | 8/1995 | Egashira et al. | |
| 5,743,816 A | * | 4/1998 | Ohsumi et al. | 473/376 |
| 5,919,101 A | * | 7/1999 | Yokota et al. | 473/374 |
| 5,967,907 A | * | 10/1999 | Takemura et al. | 473/373 |
| 6,117,026 A | * | 9/2000 | Hayashi et al. | 473/374 |
| 6,231,461 B1 | * | 5/2001 | Moriyama et al. | 250/252.1 |
| 6,361,454 B1 | * | 3/2002 | Yoshida et al. | 473/374 |
| 6,406,383 B2 | * | 6/2002 | Moriyama et al. | 473/371 |

FOREIGN PATENT DOCUMENTS

| | | |
|---|---|---|
| JP | 4-244174 | 9/1992 |
| JP | 6-142228 | 5/1994 |
| JP | 9-266959 | 10/1997 |

* cited by examiner

*Primary Examiner*—Paul T. Sewell
*Assistant Examiner*—Tom P Duong
(74) *Attorney, Agent, or Firm*—Birch, Stewart, Kolasch & Birch, LLP

(57) ABSTRACT

The present invention provides a multi-piece solid golf ball having excellent rebound characteristics when hitting at low head speed because the rebound characteristics do not depend on the head speed at the time of hitting. The present invention relates to a multi-piece solid golf ball comprising core 5 composed of inner core 1, middle core 2, and outer core 3 and at least one layer of cover 4, wherein the above-mentioned inner core has a JIS-C hardness of 63 to 83, the above-mentioned outer core has a JIS-C hardness of 63 to 83, the JIS-C hardness of the above-mentioned inner core is greater than the JIS-C hardness of the above-mentioned middle core by 4 to 40, the JIS-C hardness of the above-mentioned outer core is greater than the JIS-C hardness of the above-mentioned middle core by only 4 to 40, each of the above-mentioned core layers are composed of a vulcanized molded article of a rubber composition containing base rubber, co-crosslinking agent, organic peroxide, and when necessary organic sulfide compound, and the two formulas, $0 \leqq H_1/H_2 < 1$ and $0 \leqq H_3/H_2 < 1$ are satisfied when the amounts of organic sulfide that is added to each of the above-mentioned core layers are $H_1$, $H_2$, and $H_3$, respectively, in terms of parts by weight.

6 Claims, 3 Drawing Sheets

MULTI-PIECE SOLID GOLF BALL

FIELD OF THE INVENTION

The present invention relates to a multi-piece solid golf ball having rebound characteristics as good as a conventional two-piece solid golf ball when hitting at high head speed, and having better rebound characteristics than the conventional two-piece solid golf ball when hitting at low head speed. That is, the present invention relates a multi-piece solid golf ball having such a structure that golfers who swing a golf club at low head speed at the time of hitting are not at a disadvantage.

BACKGROUND OF THE INVENTION

Solid golf balls are classified into two-piece golf ball and one-piece golf ball. The two-piece golf ball is mainly used for round play of amateur golfers. The two-piece golf ball has excellent flight distance, but has hard and poor shot feel. The performance of the two-piece golf ball depends on the head speed at the time of hitting, and the two-piece golf ball typically has long flight distance when hitting at high head speed and has short flight distance when hitting at low head speed. However, since it happens often that a golfer who swings a golf club at low head speed at the time of hitting and a golfer who swings a golf club at high head speed at the time of hitting are in a same group at a round play, a golf ball that golfers who swing a golf club at low head speed at the time of hitting are not at a disadvantage, is required.

It has been attempted to improve the defect of the solid golf ball by various means. As a representative example, multi-piece solid golf balls, such as a three-piece solid golf ball obtained by placing an intermediate layer between a core and a cover of the two-piece solid golf ball (as described in, for example, Japanese Patent Kokai Publication Nos. 244174/1992, 142228/1994 and the like), and a four-piece solid golf ball of which the intermediate layer is formed into two-layer structure (as described in, for example, Japanese Patent Kokai Publication Nos. 266959/1997, 179797/1998, 179798/1998 and the like) are proposed.

In Japanese Patent Kokai Publication Nos. 244174/1992 and 142228/1994, a three-piece solid golf ball comprising a core formed from rubber composition, an intermediate layer and a cover formed from thermoplastic resin is described.

In Japanese Patent Kokai Publication No. 266959/1997, a four-piece solid golf ball comprising a three-layer structured core formed from rubber composition and a cover formed from thermoplastic resin is described, and a main object thereof is to improve a flight distance, shot feel and controllability, particularly shot feel and controllability at approach shot when hitting by an iron club.

In Japanese Patent Kokai Publication No. 179797/1998, a four-piece solid golf ball comprising a core formed from rubber composition, an inner intermediate layer formed from thermoplastic resin, an outer intermediate layer formed from rubber composition and a cover formed from thermoplastic resin is described. In Japanese Patent Kokai Publication No. 179798/1998, a four-piece solid golf ball comprising a core and an inner intermediate layer formed from rubber composition, an outer intermediate layer and a cover formed from thermoplastic resin is described. The two four-piece solid golf balls are designed to increase the launch angle and flight distance.

The multi-piece solid golf ball, when compared with the two-piece golf ball, has better shot feel while maintaining excellent flight performance, because the multi-piece golf ball can accomplish a various of hardness distribution. However, it is not considered that the rebound characteristics depend on the head speed at the time of hitting.

Therefore, the present inventors have proposed a golf ball, of which the rebound characteristics do not depend on the head speed at the time of hitting because of a difference in deformation behavior when hit at high head speed and low head speed by making the core a three-layer structure and adjusting the hardness of the middle layer to low (Japanese Patent Application Nos. 14422/1999, 14434/1999, 263628/1999 and the like). However, there was problem in the golf ball that sufficient rebound characteristics were obtained and sufficient flight performance was not obtained when hit at low head speed.

In addition, a method of adding various organic sulfide compounds to a conventional core has been proposed in order to improve the rebound characteristics and extend the flight distance (Japanese Patent Kokai Publication Nos. 228867/1984, 122273/1997, 80503/1998, Japanese Patent Nos. 2669051, 2778229, etc.).

A solid golf ball formed from a rubber composition comprising 4,4'-dithio-bis-dimorpholine and/or derivatives thereof is described in Japanese Patent Kokai Publication No. 228867/1984. A solid golf ball consisting of a core, inside cover and outside cover that the core is formed from a rubber composition comprising 0.05 to 5.0 parts by weight of organic sulfide compound based on 100 parts by weight of base rubber is described in Japanese Patent Kokai Publication No. 122273/1997. A solid golf ball consisting of a core that is formed from a rubber composition comprising bis(2,5-dichlorophenyl) disulfide and a cover is described in Japanese Patent Kokai Publication No. 80503/1998. A one-piece golf ball formed from a rubber composition comprising an organic sulfide compound selected from thiophenols, thiocarboyxlic acids and metal salts thereof, and a multi-layer golf ball that the core is formed from the rubber composition, and is covered by a cover directly or through a middle layer formed on the core are described in Japanese Patent No. 2669051. A multi-layer solid golf ball that the core formed from a rubber composition comprising one or more organic sulfide compounds selected from thiophenols, thiocarboxylic acids, sulfides, zinc salt of thiophenols and zinc salt of thiocarboxylic acids, is covered by a cover directly or through a middle layer formed on the core, is described in Japanese Patent No. 2778229.

In these golf balls, the rebound characteristics when hit at low head speed are improved as a result of using an organic sulfide compound in the core, but the rebound characteristics when hit at high head speed are also improved, and therefore the rebound characteristics depend on the head speed at the time of hitting. In addition, the organic sulfide compound is uniformly dispersed in the core, in the conventional methods of using the organic sulfide compound. Thus the organic sulfide compound is present in a portion of the core where it is not necessary and the organic sulfide compound is not present in sufficient amount in a portion of the core where it is necessary.

OBJECTS OF THE INVENTION

A main object of the present invention is to provide a multi-piece solid golf ball having excellent rebound characteristics when hitting at low head speed because the rebound characteristics do not depend on the head speed at the time of hitting.

According to the present invention, the object described above has been accomplished by providing a multi-layer solid golf ball comprising a core consisting of an inner core, a middle core and an outer core, and a cover formed on the core, and adjusting a JIS-C hardness of the inner core and outer core, a hardness difference between the inner core and middle core, a hardness difference between the outer core and middle core and the amount of organic sulfide compound in the inner core, middle core and outer core to a specified range. The present invention can provide a multi-piece solid golf ball having excellent rebound characteristics when hitting at low head speed because the rebound characteristics do not depend on the head speed at the time of hitting.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

Figure 1:
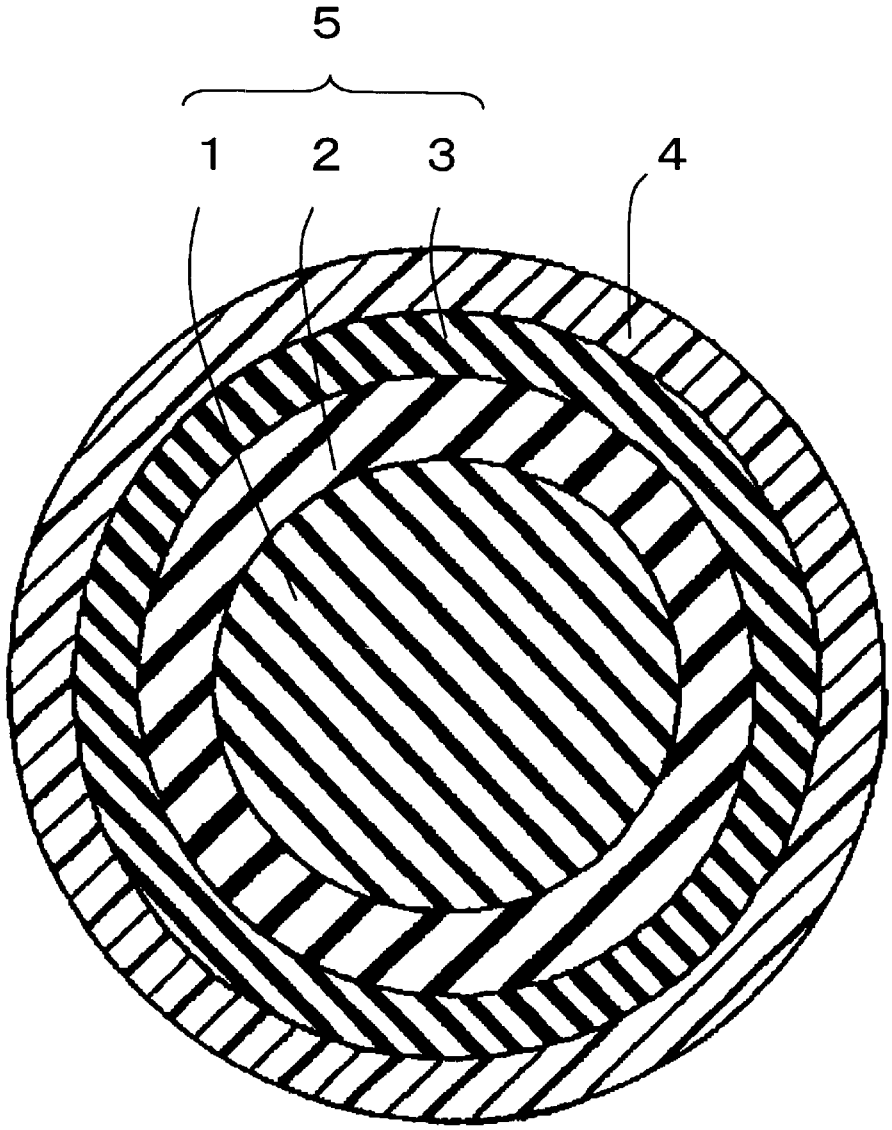
FIG. 1 is a schematic cross section illustrating one embodiment of the golf ball of the present invention.

The present invention provides a multi-piece solid golf ball comprising a core consisting of an inner core, a middle core covering the inner core and an outer core covering the middle core, and at least one layer of cover formed on the core, wherein the inner core has a JIS-C hardness of 63 to 83, the outer core has a JIS-C hardness of 63 to 83, the JIS-C hardness of the inner core is larger than the JIS-C hardness of the middle core by 4 to 40, and the JIS-C hardness of the outer core is larger than the JIS-C hardness of the middle core by 4 to 40 greater;

the inner core and outer core are formed from a vulcanized molded article of a rubber composition comprising base rubber, co-crosslinking agent, organic peroxide, and optionally organic sulfide compound;

the middle core is formed from a vulcanized molded article of a rubber composition comprising base rubber, co-crosslinking agent, organic peroxide, and organic sulfide compound; and the following two formulas are satisfied when the amount of organic sulfide compound that is added to the inner core, middle core and outer core, based on 100 parts by weight of the base rubber is $H_1$, $H_2$, and $H_3$, respectively, in terms of parts by weight:

$$0 \leqq H_1/H_2 < 1$$

$$0 \leqq H_3/H_2 < 1$$

In the golf ball of the present invention having the above structure, since energy loss is large because a deformation reaches to the middle core which has small hardness and is soft when hitting at high head speed, an increment of flight distance by hitting at high head speed cancels out an decrement of flight distance depending on the energy loss. On the other hand, since the energy loss is not large as long as hitting at high head speed because the deformation does not reach to the middle core, the outer core and the cover having large hardness only deforms, which cancels off a decrement of flight distance when hitting at low head speed. Therefore it is considered that the flight distance is approximately constant without depending on the head speed in the golf ball of the present invention.

Moreover, although it was previously thought that rebound characteristics are specified by the volume percentage of the rubber composition with standard rebound characteristics and the rubber composition with high rebound characteristics when they are layered at a specific ratio, it was discovered that rebound characteristics exceeding that estimated from the volume percentage is realized by placing the rubber composition with high rebound characteristics only at the place of considerable deformation behavior. At the same time, it was possible to obtain a golf ball of which the rebound characteristics did not depend on the head speed beyond the conventional golf ball by effectively using a rubber composition comprising organic sulfide compound because the places where deformation occurs vary with head speed at the time of hitting. Furthermore, the golf ball of the present invention also has an advantage that it is possible to provide a golf ball that is inexpensive and has high performance by using expensive organic sulfide compound only in a specified layer, or using it in larger amount in a specific layer than in other layers.

In order to practice the present invention suitably, it is desired that;

the $H_1$, $H_2$, and $H_3$ satisfy the following two formulas:

$$0 \leqq H_1/H_2 < 0.75$$

$$0 \leqq H_3/H_2 < 0.75$$

the $H_2$ be 0.1 to 10.0 and $H_1$ and $H_3$ be 0 to 1.0, the middle core comprise organic sulfide compound, and the inner core and outer core do not comprise organic sulfide compound, the middle core have a thickness of 1.0 to 7.0 mm and the middle core be placed at a distance within a range of 6.5 to 20.0 mm from the center point of the core, the middle core has a JIS-C hardness of 30 to 80.

DETAILED DESCRIPTION OF THE INVENTION

The golf ball of the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a core 5 consisting of an inner core 1, a middle core 2 covering the inner core and an outer core 3 covering the middle core, and at least one layer of cover 4 formed on the core. In order to explain the golf ball of the present invention simply, a golf ball having one layer of cover 4 will be used hereinafter for explanation. However, the golf ball of the present invention may be applied for the golf ball having two or more layers of cover.

It is required that the inner core 1 and outer core 3 in the core 5 be produced by molding while heating and pressing a rubber composition comprising a base rubber, co-crosslinking agent, organic peroxide, and optionally an organic sulfide compound, and the middle core 2 be produced by molding while heating and pressing a rubber composition comprising a base rubber, co-crosslinking agent, organic peroxide and organic sulfide compound. Since the all three layers in the core are formed from the vulcanized rubber composition, each layer has high adhesion to the contiguous layer, and it is difficult to remove off each layer from the contiguous layer. Therefore high rebound characteristics, low impact force and high durability can be maintained while balancing those.

The base rubber used for the core of the present invention may be one, which has been conventionally used for cores of solid golf balls. Preferred is high-cis polybutadiene rubber containing a cis-1,4 bond of not less than 40%, preferably not less than 80%, more preferably not less than 90%. The high-cis polybutadiene rubber may be optionally mixed with natural rubber, polyisoprene rubber, styrene-butadiene rubber, ethylene-propylene-diene rubber (EPDM) and the like in amount of 0 to 50 parts by weight based on 100 parts by weight of the base rubber.

The co-crosslinking agent can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.), a functional monomer such as triethanolpropane trimethacrylate, or mixtures thereof. The preferred co-crosslinking agent is zinc acrylate because it imparts high rebound characteristics to the resulting golf ball. The amount of co-crosslinking agent in the rubber composition is from 5 to 50 parts by weight, preferably from 10 to 40 parts by weight, based on 100 parts by weight of the base rubber. When the amount of the metal salt of the unsaturated carboxylic acid is larger than 50 parts by weight, the core is too hard, and the shot feel of the resulting golf ball is poor. On the other hand, when the amount of the metal salt of the unsaturated carboxylic acid is smaller than 5 parts by weight, it is required to increase an amount of the organic peroxide in order to impart a desired hardness to the core. Therefore, the rebound characteristics are degraded, which reduces the flight distance.

The organic peroxide includes, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.3 to 5.0 parts by weight, preferably 0.8 to 3.0 parts by weight, based on 100 parts by weight of the base rubber. When the amount of the organic peroxide is smaller than 0.3 parts by weight, the core is too soft, and the rebound characteristics are degraded, which reduces the flight distance. On the other hand, when the amount of the organic peroxide is larger than 5.0 parts by weight, it is required to decrease an amount of the co-crosslinking agent in order to impart a desired hardness to the core. Therefore, the rebound characteristics are degraded, which reduces the flight distance.

In the present invention, the amount of the organic sulfide compound added to inner core 1, middle core 2 and outer core 3 differs as previously explained, and the amount in the middle core 2 is larger than the amount in the other layers. There is also the case of comprising no organic sulfide compound comprises in the inner core 1 and outer core 3. The organic sulfide compound used for the golf ball of the present invention includes thiophenols, such as pentachlorothiophenol, pentafluorothiophenol, 4-chlorothiophenol, 3-chlorothiophenol, 4-bromothiophenol, 3-bromothiophenol, 4-fluorothiophenol, 4-t-butyl-o-thiophenol, 4-t-butylthiophenol, 2,3-dichiorothiophenol, 2,4-dichlorothiophenol, 2,5-dichlorothiophenol, 2,6-dichlorothiophenol, 3,4-dichlorothiophenol, 3,5-dichlorothiophenol, 2,4,5-trichlorothiophenol, thiosalicylic acid, methylthiosalicylic acid, o-toluenethiol, m-toluenethiol, p-toluenethiol, 3-aminothiophenol, 4-aminothiophenol, 3-methoxythiophenol, 4-methoxythiophenol, 4-mercaptphenyl sulfide, 2-benzamidothiophenol and the like; thiocarboxylic acids, such as thioacetic acid, thiobenzoic acid and the like; disulfides, such as diphenyl disulfide, bis(2-aminophenyl) disulfide, bis(4-aminophenyl) disulfide, bis(4-hydroxyphenyl) disulfide, bis(4-methylphenyl) disulfide, bis (4-t-butylphenyl) disulfide, bis(2-benzamidophenyl) disulfide, dixylyl disulfide, di(o-benzamidophenyl) disulfide, dimorpholino disulfide, bis(4-chlorophenyl) disulfide, bis(3-chlorophenyl) disulfide, bis(2-chlorophenyl) disulfide, bis(4-bromophenyl) disulfide, bis(3-bromophenyl) disulfide, bis(2-bromophenyl) disulfide, bis(2,5-dichlorophenyl) disulfide, bis(3,5-dichlorophenyl) disulfide, bis(2,4,5-trichlorophenyl) disulfide, bis(2-cyanophenyl) disulfide, bis(2-nitrophenyl) disulfide, bis(4-nitrophenyl) disulfide, bis(2,4-dinitrophenyl) disulfide, 2,2-dithio dibenzoic acid, 5,5-dithiobis(2-nitrobenzoic acid), bis (pentafluorophenyl) disulfide, dibenzyl disulfide, di-t-dodecyl disulfide, diallyl disulfide, difurfuryl disulfide, 2,2-dibenzothiazoryl disulfide, bis(2-naphthyl) disulfide, bis(4-mercaptphenyl) disulfide, 4-(2-benzothiazoryldithio) morpholine, 2,2-dipyridinyl disulfide, 2,2-dithiobis(5-nitropyridine), 2,2-dithiodianiline, 4,4-dithiodianiline, dithiodiglycolic acid, 4,4'-dithiodimorpholine, L-cystine and the like; thiurams, such as tetramethylthiuram disulfide, tetraethylthiuram disulfide, tetrabutylthiuram disulfide, tetramethylthiuram monosulfide, N,N'-dimethyl-N,N'-diphenylthiuram disulfide, dipentamethylenethiuram tetrasulfide and the like; thiazoles, such as 2-mercaptbenzothiazole, 2-mercaptbenzothiazole sodium salt, 2-mercaptbenzothiazole zinc salt, 2-mercaptbenzothiazole dicyclohexylamine salt, 2-(N,N-diethylcarbamylthio)benzothiazole, 2-(4'-morphorinodithio) benzothiazole, 2,5-dimercapt-1,3,4-thiadiazole, Bismuthiol I, Bismuthiol II, 2-amino-5-mercapt-1,3,4-thiadiazole, trithiocyanuric acid and the like; sulfenamides; thioureas; dithiocarbamates; and mixtures thereof. Preferred are thiophenols, disulfides and the like, in view of the technical effect of improving rebound characteristics and its cheapness.

It is required that the amount of the organic sulfide compound added to inner core 1, middle core 2 and outer core 3 satisfy the following two formulas:

$$0 \leqq H_1/H_2 < 1$$

$$0 \leqq H_3/H_2 < 1$$

preferably the following two formulas:

$$0 \leqq H_1/H_2 < 0.75$$

$$0 \leqq H_3/H_2 < 0.75,$$

when they are $H_1$, $H_2$ and $H_3$, respectively, in terms of parts by weight per 100 parts by weight of the base rubber. When the $H_2$ is less than the $H_1$, or the $H_2$ is less than the $H_3$, the head speed dependency of rebound characteristics will increase and the rebound characteristics when hit at low head speed will readily drop. Moreover, the $H_2$ and $H_3$ will be too high and the cost will increase due to an increase in the amount of organic sulfide compound added, or the $H_2$ will be too low and the rebound characteristics are degraded. Moreover, it is desired that the ratios $H_2/H_1$ and $H_2/H_3$ be not less than 1.3, preferably not less than 1.5, more preferably not less than 2.0. When the ratios $H_2/H_1$ and $H_2/H_3$ are less than 1.3, the technical effect of reducing head speed dependency of rebound characteristics is not sufficiently obtained.

Furthermore, it is desirable that $H_2$ be 0.1 to 10.0, preferably 0.2 to 5.0, more preferably 0.5 to 2.0 and that $H_1$ and $H_3$ be 0 to 1.0, preferably 0 to 0.8, more preferably 0 to 0.5, most preferably 0. When the $H_2$ is smaller than 0.1, the technical effect of improving the rebound characteristics accomplished by using the organic sulfide compound is not sufficiently obtained. On the other hand, when the $H_2$ is larger than 10.0, the vulcanization speed is low and the productivity is degraded, and the material cost is high. When the $H_1$ and $H_3$ is larger than 1.0, the technical effect of reducing head speed dependency of rebound characteristics is not sufficiently obtained, that is, the flight distance when hit at low head speed is short, and the cost is high due to an increase in the amount of organic sulfide compound added.

With respect to the organic sulfide compound, embodiments of the multi-piece solid golf balls of the present invention comprising core 5 consisting of inner core 1, middle core 2 covering this inner core, and outer core 3 covering this middle core, and at least one layer of cover 4 formed on the core are as follows:

(i) A multi-piece solid golf ball wherein the middle core 2 comprises the organic sulfide compound and the inner core 1 and outer core 3 do not comprise the organic sulfide compound.

(ii) A multi-piece solid golf ball, wherein the inner core 1 and middle core 2 comprise the organic sulfide compound and the outer core 3 does not comprise the organic sulfide compound and the amount of the organic sulfide compound added to above-mentioned middle core 2 is greater than the amount of the organic sulfide compound added to is inner core 1.

(iii) A multi-piece solid golf ball wherein the outer core 3 and middle core 2 comprise the organic sulfide compound and the inner core 1 does not comprise the organic sulfide compound and the amount of the organic sulfide compound added to the middle core 2 is greater than the amount of the organic sulfide compound added to the outer core 3.

(iv) A multi-piece solid golf ball wherein the inner core 1, middle core 2, and outer core 3 comprise the organic sulfide compound and the amount of organic sulfide compound added to the middle core 2 is greater than the amount of the organic sulfide compound added to the inner core 1, and the amount of organic sulfide compound added to the middle core 2 is greater than the amount of the organic sulfide compound added to the outer core 3.

Fillers, such as inorganic fillers (specifically, zinc oxide, barium sulfate, calcium carbonate, etc.), high-specific-gravity metal fillers (for instance, tungsten powder, molybdenum powder, etc.) and mixtures thereof, antioxidants or peptizing agent, or other components, which have been conventionally used for preparing the core of solid golf balls, can be further added as needed to the core of the golf ball of the present invention. If used, the amount of filler added is 3 to 50 parts by weight, preferably 10 to 30 parts by weight, based on 100 parts by weight of the base rubber. When the amount of the filler is smaller than 3 parts by weight, it will be difficult to adjust the weight of the resulting golf ball. On the other hand, when the amount of the filler is larger than 50 parts by weight, the weight ratio of the rubber component in the core is small, and the rebound characteristics reduce too much. Preferably the amount of the antioxidant is 0.1 to 1.0 part by weight and the amount of the peptizing agent is 0.1 to 5.0 parts by weight, based on 100 parts by weight of the base rubber.

Thus, inner core 1, middle core 2, and outer core 3 of the present invention are formed from the same components, but the desired hardness can be accomplished by adjusting the amount of the co-crosslinking agent, the amount of the organic peroxide, the vulcanization condition and the like to proper ranges.

Figure 2:
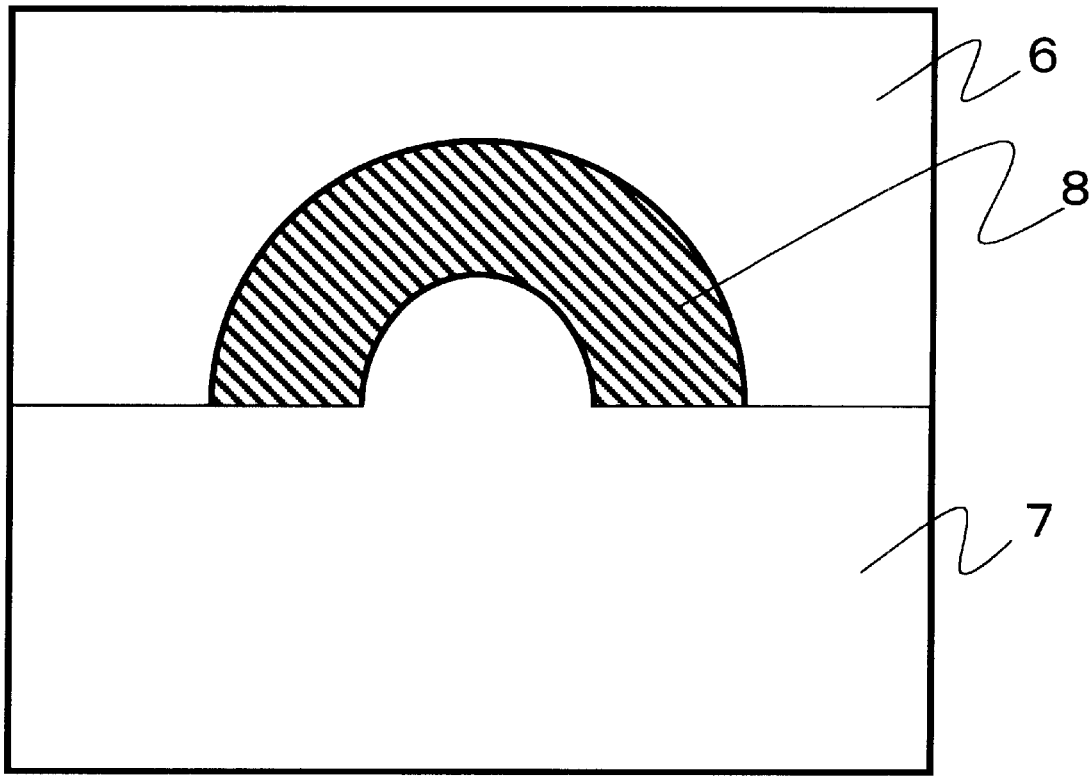
FIG. 2 is a schematic cross section illustrating one embodiment of a mold for molding a semi-spherical half-shell for the middle core or the outer core of the golf ball of the present invention.
Figure 3:
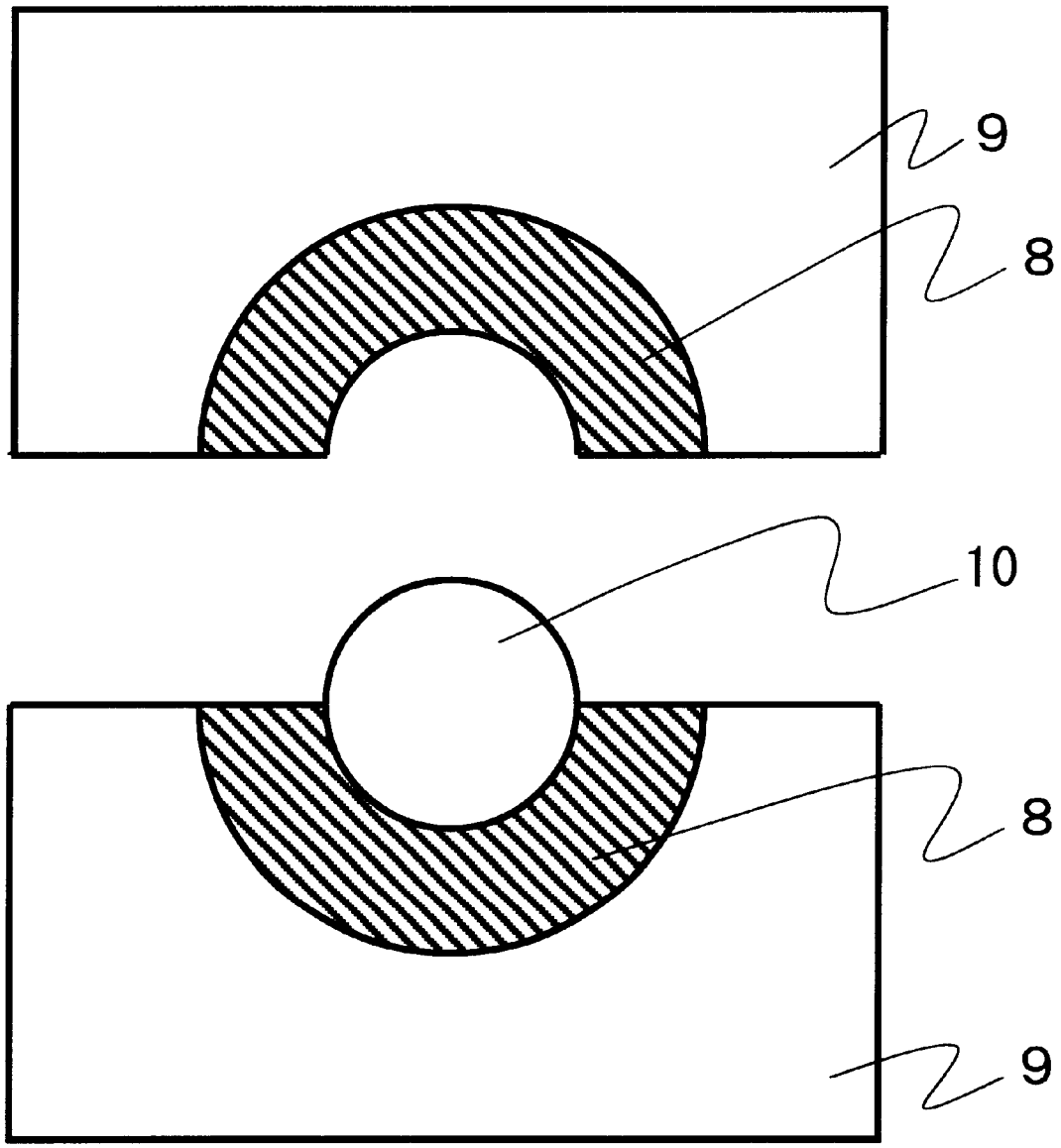
FIG. 3 is a schematic cross section illustrating one embodiment of a mold for molding a spherical molded article obtained by covering with the middle core or the outer core of the golf ball of the present invention.

The process of producing the core of the golf ball of the present invention will be explained with reference to FIG. 2 and FIG. 3. FIG. 2 is a schematic cross section illustrating one embodiment of a mold for molding a semi-vulcanized semi-spherical half-shell used for the golf ball of the present invention. FIG. 3 is a schematic cross section illustrating one embodiment of a mold for molding a core of the golf ball of the present invention. The rubber composition for the inner core is mixed, and press-molded in a mold, which is composed of an upper mold and a lower mold having a semi-spherical cavity, at 130 to 160° C. for 10 to 60 minutes to prepare a vulcanized spherical molded article for the inner core. The rubber composition for middle core then is mixed, and press-molded at 90 to 165° C. for 20 seconds to 5 minutes using a mold having a semi-spherical cavity 6 and a male plug mold 7 having a semi-spherical convex having the same diameter as the vulcanized spherical molded article for the inner core as described in FIG. 2 to obtain a semi-vulcanized semi-spherical half-shell 8 for the middle core. The vulcanized molded article for the inner core 10 is covered with the two semi-vulcanized semi-spherical half-shells 8 for the middle core, and then press-molded at 140 to 160° C. for 10 to 60 minutes in a mold 9 as described in FIG. 3 to prepare a two-layer structured core.

The rubber composition for outer core then mixed, and a semi-vulcanized semi-spherical half-shell 8 for the outer core are prepared in the same procedure as the semi-vulcanized semi-spherical half-shell for the middle core except for using a mold having a semi-spherical cavity 6 and a male plug mold 7 having a semi-spherical convex having the same diameter as the two-layer structured core as described in FIG. 2. The two-layer structured core is covered with the two semi-vulcanized semi-spherical half-shells 8 for the outer layer core, and then press-molded at 140 to 160° C. for 10 to 60 minutes in a mold 9 as described in FIG. 3 to prepare the core 5 having a three-layer structure. The method of preparing the core is not limited to the press-molding method, but may be conducted by using a rubber injection-molding method. After press molding and vulcanizing the inner core, the two-layer structure core and the core (the three-layer structured core) respectively, the surface of each molded article can be buffed to improve the adhesion to the contiguous layer.

In the golf ball of the present invention, it is required that the inner core 1 have a JIS-C hardness of 63 to 83. When the hardness is smaller than 63, the inner core is too soft, and the rebound characteristics are degraded, which reduces the flight distance, and the desired physical properties are not be obtained. Therefore the hardness is preferably not less than 66, more preferably not less than 68. On the other hand, the hardness is larger than 83, the inner core is too hard, and the shot feel is hard and poor. Therefore the hardness is preferably not more than 82, more preferably not more than 80.

In the golf ball of the present invention, it is required that the JIS-C hardness of the inner core 1 be higher than that of the middle core 2 by 4 to 40. When the hardness difference is smaller than 4, the technical effect of the present invention accomplished by placing a soft layer between two hard layers is not sufficiently obtained. Therefore the hardness difference is preferably not less than 5. On the other hand, the hardness difference is larger than 40, the rebound characteristics are degraded, or the durability between the both layers is degraded. Therefore the hardness difference is preferably not more than 30.

In the golf ball of the present invention, it is desired that the middle core 2 have a JIS-C hardness of 30 to 80, preferably 40 to 75. When the hardness is smaller than 30, the middle core is too soft, and the rebound characteristics are degraded, and the durability is degraded because the stress is concentrated in the middle core. On the other hand, when the hardness difference is larger than 80, the middle core is too hard, and the technical effect of the present invention accomplished by placing a soft layer between two hard layers is not sufficiently obtained.

In the golf ball of the present invention, it is desired that the middle core 2 have a thickness of 1.0 to 7.0 mm, preferably 1.5 to 5.0 mm. When the thickness is smaller than 1.0 mm, the technical effect of reducing the rebound characteristics is degraded when large deformation reaches to the middle core when hitting at high head speed. Therefore the technical effect of the present invention that the rebound characteristics do not depend on the head speed, is not sufficiently obtained. On the other hand, when the thickness is larger than 7.0 mm, the deformation reaches to the middle core when hitting at low head speed. Therefore the above effect is not sufficiently obtained.

In the golf ball of the present invention, it is desired that the middle core 2 be placed at a distance within the range of 6.5 to 20.0 mm, preferably 8.0 to 18.0 mm from the center point of the core 5. When the distance from the center point of the core is smaller than 6.5 mm, large deformation does not reach to the middle core 2 when hitting at both high and low head speed. Therefore the technical effect of the present invention that the rebound characteristics do not depend on the head speed, is not sufficiently obtained. On the other hand, when the distance from the center point is larger than 20.0 mm, the deformation reaches to the middle core 2 when hitting at both high and low head speed. Therefore the technical effect of the present invention that the rebound characteristics do not depend on the head speed, is not sufficiently obtained. The core 5 having a three-layer structure of the present invention preferably has such a structure that the middle core 2 is placed at a distance within the range of 6.5 to 20.0 mm from the center point of the core 5 and has a thickness of 1.0 to 7.0 mm.

In the golf ball of the present invention, it is required that the outer core 3 has a JIS-C hardness of 63 to 83. When the hardness is smaller than 63, the shot feel is soft and good, but the rebound characteristics are degraded, which reduces the flight distance, and the durability is also degraded. Therefore the hardness is preferably not less than 66, more preferably not less than 68. On the other hand, the hardness is larger than 83, the outer core is too hard, and the shot feel is hard and poor. Particularly for such golfers who swing a golf club at low head speed at the time of hitting that it is expected to obtain the technical effect of the present invention, the shot feel is very hard and poor. Therefore the hardness is preferably not more than 82, more preferably not more than 80.

In the golf ball of the present invention, it is required that the JIS-C hardness of the outer core 3 is higher than that of the middle core 2 by 4 to 40. When the hardness difference is smaller than 4, the technical effect of the present invention accomplished by placing a soft layer between two hard layers is not sufficiently obtained. Therefore the hardness difference is preferably not less than 5. On the other hand, the hardness difference is larger than 40, the rebound characteristics are degraded, or the durability between the both layers is degraded. Therefore the hardness difference is preferably not more than 30.

The hardness of the inner core is determined by measuring a hardness at the center point of the core in section, and the hardness of the middle core and outer core are determined by measuring a hardness at the center position in the radial direction thereof in section, after the resulting golf ball is cut into two equal parts.

It is desirable that the diameter of core 5 be 34.0 to 41.0 mm, preferably 37.0 to 40.5 mm. When the diameter of the core is smaller than 34.0 mm, the cover is too thick, and it is difficult that deformation at the time of hitting reaches to the core, which reduces the rebound characteristics. On the other hand, when the diameter of the core is greater than 41.0 mm, the cover is too thin, and the durability of the cover is degraded.

At least one layer of cover 4 is covered on the core 5. If the cover 4 of the present invention has a single-layer structure, it contains as a base resin thermoplastic resin, particularly ionomer resin which has been conventionally used for the cover of golf balls. The ionomer resin may be a copolymer of α-olefin and α,β-unsaturated carboxylic acid having 3 to 8 carbon atoms, of which a portion of carboxylic acid groups is neutralized with metal ion, or mixtures thereof. Examples of the α-olefins in the ionomer resin preferably include ethylene, propylene and the like. Examples of the α,β-unsaturated carboxylic acid in the ionomer preferably include acrylic acid, methacrylic acid and the like. The metal ion which neutralizes a portion of carboxylic acid groups of the copolymer includes an alkali metal ion, such as a sodium ion, a potassium ion, a lithium ion and the like; a divalent metal ion, such as a zinc ion, a calcium ion, a magnesium ion and the like; a trivalent metal ion, such as an aluminum, a neodymium ion and the like; and mixture thereof. Preferred are sodium ions, zinc ions, lithium ions and the like, in view of rebound characteristics, durability and the like. The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1706, Hi-milan 1707, Hi-milan AM7315, Hi-milan AM7317 and the like. Examples of the ionomer resins, which are commercially available from Du Pont Co., include Surlyn 7930, Surlyn 8511, Surlyn 8512 and the like. Examples of the ionomer resins, which are commercially available from Exxon Chemical Co., include Iotek 7010, Iotek 8000 and the like. These ionomer resins may be used alone or in combination.

If the cover 4 for the golf ball of the present invention has a multi-layer structure which has two or more layers, as suitable materials for the cover, one or combinations of two or more members selected from the group consisting of thermoplastic resin and thermoplastic elastomer may be used. Example of the thermoplastic resin includes the ionomer resin as described above. Examples of thermoplastic elastomers include polyamide thermoplastic elastomers, which are commercially available from Toray Co., Ltd. under the trade name of "Pebax", such as "Pebax 2533"; polyester thermoplastic elastomers, which are commercially available from Toray-Do Pont Co., Ltd. under the trade name of "Hytrel", such as "Hytrel 3548" and "Hytrel 4047"); polyurethane thermoplastic elastomers, which are commercially available from Takeda Verdishe Co., Ltd. under the trade name of "Elastoran", such as "Elastoran ET880"; polyurethane thermoplastic elastomers, which are commercially available from Dainippon Ink Chemical Co., Ltd. under the trade name of "Pandex", such as "Pandex T-8180", which is commercially available from Dainippon Ink Chemical Co., Ltd. and the like.

The cover used in the present invention may optionally contain pigments (such as titanium dioxide, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover.

A method of covering on the core with the cover 4 is not specifically limited, but may be a conventional method. For example, there can be used a method comprising molding the cover composition into a semi-spherical half-shell in advance, covering the core, which is covered with the outer layer core, with the two half-shells, followed by pressure molding at 130 to 170° C. for 1 to 5 minutes, or a method comprising injection molding the cover composition directly on the core to cover it. At the time of cover molding, many depressions called "dimples" may be optionally formed on the surface of the golf ball. Furthermore, paint finishing or marking with a stamp may be optionally provided after the cover is molded for commercial purpose. In the golf ball of the present invention, the cover has a total thickness of 1.0 to 4.5 mm, preferably 1.5 to 4.0 mm. When the thickness is smaller than 1.0 mm, the rebound characteristics and durability are degraded. On the other hand, when the thickness is larger than 4.5 mm, the shot feel is hard and poor.

EXAMPLES

The following Examples and Comparative Examples further illustrate the present invention in detail but are not to be construed to limit the scope of the present invention.

(i) Production of Vulcanized Spherical Molded Article for Inner Core

The rubber compositions for the inner core having the formulation shown in Tables 1 to 5 were mixed, and the mixtures were then press-molded at 130 to 160° C. for 10 to 60 minutes in the mold, which is composed of an upper mold and a lower mold having a semi-spherical cavity, to obtain vulcanized spherical molded articles for the inner cores having a diameter shown in Tables 7 to 11. The surface of the molded article was then buffed to improve the adhesion to the middle core.

(ii) Production of Semi-Vulcanized Semi-Spherical Half-Shell for the Middle Core The rubber compositions for middle core having the formulation shown in Tables 1 to 5 were mixed, and the mixtures were then press-molded at 90 to 165° C. for 20 seconds to 3 minutes in the mold (6, 7) having a semi-spherical convex having the same diameter as the vulcanized spherical molded article for the inner core produced in the step (i) as described in FIG. 2 to obtain semi-vulcanized semi-spherical half-shells 8 for the middle core.

(iii) Production of Two-Layer Structured Core

The vulcanized spherical molded articles for the inner core 10 produced in the step (i) were covered with the two semi-vulcanized semi-spherical half-shells 8 for the middle core produced in the step (ii), and then vulcanized by press-molding at 140 to 160° C. for 10 to 60 minutes in the mold 9 as described in FIG. 3 to obtain two-layer structured cores. The surface of the two-layer structured core was then buffed to improve the adhesion to the outer core.

(iv) Production of Semi-Vulcanized Semi-Spherical Half-Shell for the Outer Core

The rubber compositions for outer core having the formulation shown in Tables 1 to 5 were mixed, and semi-vulcanized semi-spherical half-shells 8 for the outer layer core are produced as described in the step (ii) except for using the mold (6, 7) having a semi-spherical convex having the same diameter as the two-layer structured core produced in the step (iii) as described in FIG. 2.

(v) Production of Core

The two-layer structured cores 10 produced in the step (iii) were covered with the two semi-vulcanized semi-spherical half-shells 8 for the outer core produced in the step (iv), and then press-molded at 140 to 160° C. for 10 to 40 minutes in the mold 9 as described in FIG. 3 to prepare the cores having a three-layer structure, which has a diameter shown in Tables 7 to 11.

TABLE 1

| | | Example No. | | | | |
|---|---|---|---|---|---|---|
| | | 1 | 2 | 3 | 4 | 5 |
| (Inner core) | | | | | | |
| BR01 | (Note 1) | 100 | 100 | 100 | 100 | 100 |
| Zinc acrylate | (Note 2) | 22 | 22 | 22 | 22 | 22 |
| Zinc oxide | (Note 3) | 23 | 23 | 23 | 23 | 23 |
| Dicumyl peroxide | (Note 4) | 0.5 | 0.5 | 0.5 | 0.5 | 0.5 |
| (Middle core) | | | | | | |
| BR01 | (Note 1) | 100 | 100 | 100 | 100 | 100 |
| Zinc acrylate | (Note 2) | 12 | 16 | 20 | 12 | 16 |
| Zinc oxide | (Note 3) | 26 | 25 | 24 | 26 | 25 |
| Dicumyl peroxide | (Note 4) | 0.8 | 0.8 | 0.8 | 0.8 | 0.8 |
| Pentachlorothiophenol | | 0.5 | 0.5 | 0.5 | — | — |
| Diphenyl disulfide | | — | — | — | 0.5 | 0.5 |
| (Outer core) | | | | | | |
| BR01 | (Note 1) | 100 | 100 | 100 | 100 | 100 |
| Zinc acrylate | (Note 2) | 22 | 22 | 22 | 22 | 22 |
| Zinc oxide | (Note 3) | 23 | 23 | 23 | 23 | 23 |
| Dicumyl peroxide | (Note 4) | 0.5 | 0.5 | 0.5 | 0.5 | 0.5 |

TABLE 2

Core composition (parts by weight)

| | | Example No. | | | | |
|---|---|---|---|---|---|---|
| | | 6 | 7 | 8 | 9 | 10 |
| (Inner core) | | | | | | |
| BR01 | (Note 1) | 100 | 100 | 100 | 100 | 100 |
| Zinc acrylate | (Note 2) | 22 | 36 | 36 | 36 | 22 |
| Zinc oxide | (Note 3) | 23 | 18 | 18 | 18 | 23 |
| Dicumyl peroxide | (Note 4) | 0.5 | 0.5 | 0.5 | 0.5 | 0.5 |
| (Middle core) | | | | | | |
| BR01 | (Note 1) | 100 | 100 | 100 | 100 | 100 |
| Zinc acrylate | (Note 2) | 20 | 12 | 20 | 30 | 12 |
| Zinc oxide | (Note 3) | 24 | 26 | 24 | 20 | 26 |
| Dicumyl peroxide | (Note 4) | 0.8 | 0.8 | 0.8 | 0.8 | 0.8 |
| Pentachlorothiophenol | | — | 0.5 | 0.5 | 0.5 | 0.5 |
| Diphenyl disulfide | 0.5 | — | — | — | — | |
| (Outer core) | | | | | | |
| BR01 | (Note 1) | 100 | 100 | 100 | 100 | 100 |
| Zinc acrylate | (Note 2) | 22 | 36 | 36 | 36 | 22 |
| Zinc oxide | (Note 3) | 23 | 18 | 18 | 18 | 23 |
| Dicumyl peroxide | (Note 4) | 0.5 | 0.5 | 0.5 | 0.5 | 0.5 |

TABLE 3

| Core composition (parts by weight) | | Example No. | | | | |
|---|---|---|---|---|---|---|
| | | 11 | 12 | 13 | 14 | 15 |
| (Inner core) | | | | | | |
| BR01 | (Note 1) | 100 | 100 | 100 | 100 | 100 |
| Zinc acrylate | (Note 2) | 22 | 22 | 22 | 22 | 22 |
| Zinc oxide | (Note 3) | 23 | 23 | 23 | 23 | 23 |
| Dicumyl peroxide | (Note 4) | 0.5 | 0.5 | 0.5 | 0.5 | 0.5 |
| (Middle core) | | | | | | |
| BR01 | (Note 1) | 100 | 100 | 100 | 100 | 100 |
| Zinc acrylate | (Note 2) | 12 | 12 | 12 | 12 | 12 |
| Zinc oxide | (Note 3) | 26 | 26 | 26 | 26 | 26 |
| Dicumyl peroxide | (Note 4) | 0.8 | 0.8 | 0.8 | 0.8 | 0.8 |
| Pentachlorothiophenol | | 0.5 | 0.5 | 0.5 | 0.5 | 0.5 |
| Diphenyl disulfide | | — | — | — | — | — |
| (Outer core) | | | | | | |
| BR01 | (Note 1) | 100 | 100 | 100 | 100 | 100 |
| Zinc acrylate | (Note 2) | 22 | 22 | 22 | 22 | 22 |
| Zinc oxide | (Note 3) | 23 | 23 | 23 | 23 | 23 |
| Dicumyl peroxide | (Note 4) | 0.5 | 0.5 | 0.5 | 0.5 | 0.5 |

TABLE 4

| Core composition (parts by weight) | | Example No. | | |
|---|---|---|---|---|
| | | 16 | 17 | 18 |
| (Inner core) | | | | |
| BR01 | (Note 1) | 100 | 100 | 100 |
| Zinc acrylate | (Note 2) | 22 | 22 | 22 |
| Zinc oxide | (Note 3) | 23 | 23 | 23 |
| Dicumyl peroxide | (Note 4) | 0.5 | 0.5 | 0.5 |
| Diphenyl disulfide | | 0.04 | 0.04 | — |
| (Middle core) | | | | |
| BR01 | (Note 1) | 100 | 100 | 100 |
| Zinc acrylate | (Note 2) | 12 | 12 | 12 |
| Zinc oxide | (Note 3) | 26 | 26 | 26 |
| Dicumyl peroxide | (Note 4) | 0.8 | 0.8 | 0.8 |
| Diphenyl disulfide | | 0.5 | 0.5 | 0.5 |
| (Outer core) | | | | |
| BR01 | (Note 1) | 100 | 100 | 100 |
| Zinc acrylate | (Note 2) | 22 | 22 | 22 |
| Zinc oxide | (Note 3) | 23 | 23 | 23 |
| Dicumyl peroxide | (Note 4) | 0.5 | 0.5 | 0.5 |
| Diphenyl disulfide | | 0.04 | — | 0.04 |

TABLE 5

| Core composition (parts by weight) | Comparative Example No. | | | | |
|---|---|---|---|---|---|
| | 1 | 2 | 3 | 4 | 5 |
| (Inner core) | | | | | |
| BR01 (Note 1) | 100 | 100 | 100 | 100 | 100 |
| Zinc acrylate (Note 2) | 22 | 16 | 36 | 22 | 22 |
| Zinc oxide (Note 3) | 23 | 25 | 18 | 23 | 23 |
| Dicumyl peroxide (Note 4) | 0.5 | 0.5 | 0.5 | 0.5 | 0.5 |
| Diphenyl disulfide | — | — | — | — | 0.04 |

TABLE 5-continued

| Core composition (parts by weight) | Comparative Example No. | | | | |
|---|---|---|---|---|---|
| | 1 | 2 | 3 | 4 | 5 |
| (Middle core) | | | | | |
| BR01 (Note 1) | 100 | 100 | 100 | 100 | 100 |
| Zinc acrylate (Note 2) | 16 | 12 | 8 | 25 | 12 |
| Zinc oxide (Note 3) | 25 | 26 | 28 | 24 | 26 |
| Dicumyl peroxide (Note 4) | 0.8 | 0.8 | 0.8 | 0.8 | 0.8 |
| Diphenyl disulfide | — | 0.5 | 0.5 | 0.5 | 0.04 |
| (Outer core) | | | | | |
| BR01 (Note 1) | 100 | 100 | 100 | 100 | 100 |
| Zinc acrylate (Note 2) | 22 | 16 | 36 | 22 | 22 |
| Zinc oxide (Note 3) | 23 | 25 | 18 | 23 | 23 |
| Dicumyl peroxide (Note 4) | 0.5 | 0.5 | 0.5 | 0.5 | 0.5 |
| Diphenyl disulfide | — | — | — | — | 0.04 |

(Note 1) High-cis polybutadiene rubber available from JSR Co., Ltd. (1,4-cis-polybutadiene content: 97.1%)
(Note 2) Zinc acrylate available from Asada Chemical Co., Ltd.
(Note 3) Zinc oxide available from Toho Aen Co., Ltd.
(Note 4) Dicumyl peroxide available from Nippon Yushi Co., Ltd. under the trade name "Percumyl D" (Half-life period at 175° C.: 1 minute)

(vi) Preparation of Cover Compositions

The formulation materials shown in Table 6 were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 200 to 260° C. at the die position of the extruder.

TABLE 6

| Cover composition | Amount (parts by weight) |
|---|---|
| Hi-milan 1605 (Note 5) | 50 |
| Hi-milan 1706 (Note 6) | 50 |
| Titanium dioxide | 2 |

(Note 5) Hi-milan 1605 (trade name), ethylene-methacrylic acid copolymer ionomer resin obtained by neutralizing with sodium ion, manufactured by Mitsui Du Pont Polychemical Co., Ltd.
(Note 6) Hi-milan 1706 (trade name), ethylene-methacrylic acid copolymer ionomer resin obtained by neutralizing with zinc ion, manufactured by Mitsui Du Pont Polychemical Co., Ltd.

Examples 1 to 18 and Comparative Examples 1 to 5

The cover composition was covered on the resulting core 5 having three-layered structure by injection molding to form a cover layer 4. Then, paint was applied on the surface to produce golf ball having a diameter of 42.8 mm and a weight of 45.0 to 45.4 g. After the resulting golf ball was cut into two equal parts, JIS-C hardness of each layer of the core (a, b and c) was measured, and radius of the inner core ($h_1$) and radius of the two-layer structured core obtained by covering the inner core with the middle core ($h_2$), which are used for indicating the position of the middle core, were measured. The results are shown in Tables 7 to 11. With respect to the resulting golf balls, the coefficient of restitution was measured. The results are shown in the same Tables. The test methods are as follows.

(Test Method)

(1) JIS-C Hardness of Core

After the resulting golf ball is cut into two equal parts, JIS-C hardness of the inner core is determined by measuring a hardness at the center point of the core in section, and the hardness of the middle core and outer core are determined by measuring a hardness at the center position in the radial direction thereof in section. The JIS-C hardness was measured with a JIS-C hardness meter according to JIS K 6301.

(2) Coefficient of Restitution

A golf ball was struck at a speed of 35 m/sec or 45 m/sec against an aluminum cylinder by hitting the golf ball using the aluminum cylinder, and the velocity of the cylinder and the golf ball before and after the strike were measured by a laser. The coefficient of restitution of the golf ball was calculated from the velocity and the weight of both the cylinder and the golf ball. The measurement was conducted 5 times for each golf ball, and the average is shown as the coefficient of restitution of the golf ball, which is indicated by an index when that of Comparative Example 1 is 100. The coefficient of restitution when the velocity is 35 m/sec is represented by "coefficient of restitution A", and the coefficient of restitution when the velocity is 45 m/sec is represented by "coefficient of restitution B". The larger the coefficient of restitution is, the more excellent the rebound characteristics are. Moreover, the difference between the two (A–B) was calculated and is shown in the same table. When the difference (A–B) was positive, hitting at 35 m/sec became an advantage as the value became higher, while when it was negative, hitting at 45 m/second was an advantage.

TABLE 7

| | Example No. | | | | |
|---|---|---|---|---|---|
| Test item | 1 | 2 | 3 | 4 | 5 |
| Inner core hardness (a) | 70 | 70 | 70 | 70 | 70 |
| Middle core hardness (b) | 46 | 54 | 65 | 47 | 55 |
| Outer core hardness (c) | 70 | 70 | 70 | 70 | 70 |
| Difference in hardness (a–b) | 24 | 16 | 5 | 23 | 15 |
| Difference in hardness (c–b) | 24 | 16 | 5 | 23 | 15 |
| Inner core diameter (mm) | 20.4 | 20.4 | 20.4 | 20.4 | 20.4 |
| Middle core thickness (mm) | 1.6 | 1.6 | 1.6 | 1.6 | 1.6 |
| Outer core thickness (mm) | 7.4 | 7.4 | 7.4 | 7.4 | 7.4 |
| Position of middle layer from core center | | | | | |
| Inside $h_1$ (mm) | 10.2 | 10.2 | 10.2 | 10.2 | 10.2 |
| Outer $h_2$ (mm) | 11.8 | 11.8 | 11.8 | 11.8 | 11.8 |
| Core diameter (mm) | 38.4 | 38.4 | 38.4 | 38.4 | 38.4 |
| Cover thickness (mm) | 2.3 | 2.3 | 2.3 | 2.3 | 2.3 |
| (Ball properties) | | | | | |
| Coefficient of restitution A (35) | 110 | 112 | 114 | 108 | 110 |
| Coefficient of restitution B (45) | 106 | 107 | 108 | 104 | 106 |
| A–B | 4 | 5 | 6 | 4 | 4 |

TABLE 8

| | Example No. | | | | |
|---|---|---|---|---|---|
| Test item | 6 | 7 | 8 | 9 | 10 |
| Inner core hardness (a) | 70 | 82 | 82 | 82 | 70 |
| Middle core hardness (b) | 65 | 46 | 65 | 76 | 46 |
| Outer core hardness (c) | 70 | 82 | 82 | 82 | 70 |
| Difference in hardness (a–b) | 5 | 36 | 17 | 6 | 24 |
| Difference in hardness (c–b) | 5 | 36 | 17 | 6 | 24 |
| Inner core diameter (mm) | 20.4 | 20.4 | 20.4 | 20.4 | 13 |
| Middle core thickness (mm) | 1.6 | 1.6 | 1.6 | 1.6 | 1.0 |
| Outer core thickness (mm) | 7.4 | 7.4 | 7.4 | 7.4 | 11.7 |
| Position of middle layer from core center | | | | | |
| Inside $h_1$ (mm) | 10.2 | 10.2 | 10.2 | 10.2 | 6.5 |
| Outer $h_2$ (mm) | 11.8 | 11.8 | 11.8 | 11.8 | 7.5 |
| Core diameter (mm) | 38.4 | 38.4 | 38.4 | 38.4 | 38.4 |
| Cover thickness | 2.3 | 2.3 | 2.3 | 2.3 | 2.3 |
| (Ball properties) | | | | | |
| Coefficient of restitution A (35) | 113 | 113 | 117 | 119 | 111 |
| Coefficient of restitution B (45) | 107 | 107 | 110 | 114 | 109 |
| A–B | 6 | 6 | 7 | 5 | 2 |

TABLE 9

| | Example No. | | | | |
|---|---|---|---|---|---|
| Test item | 11 | 12 | 13 | 14 | 15 |
| Inner core hardness (a) | 70 | 70 | 70 | 70 | 70 |
| Middle core hardness (b) | 46 | 46 | 46 | 46 | 46 |
| Outer core hardness (c) | 70 | 70 | 70 | 70 | 70 |
| Difference in hardness (a–b) | 24 | 24 | 24 | 24 | 24 |
| Difference in hardness (c–b) | 24 | 24 | 24 | 24 | 24 |
| Inner core diameter (mm) | 13 | 19 | 19 | 20.4 | 34 |
| Middle core thickness (mm) | 7.0 | 1.0 | 7.0 | 1.6 | 1.6 |
| Outer core thickness (mm) | 5.7 | 8.7 | 2.7 | 5.2 | 1.8 |
| Position of middle layer from core center | | | | | |
| Inside $h_1$ (mm) | 6.5 | 9.5 | 9.5 | 10.2 | 17.0 |
| Outer $h_2$ (mm) | 13.5 | 10.5 | 16.5 | 11.8 | 18.6 |
| Core diameter (mm) | 38.4 | 38.4 | 38.4 | 34.0 | 40.8 |
| Cover thickness (mm) | 2.3 | 2.3 | 2.3 | 4.5 | 1.1 |
| (Ball properties) | | | | | |
| Coefficient of restitution A (35) | 106 | 110 | 105 | 104 | 116 |
| Coefficient of restitution B (45) | 104 | 108 | 103 | 101 | 112 |
| A–B | 2 | 2 | 2 | 4 | 4 |

TABLE 10

| | Example No. | | |
|---|---|---|---|
| Test item | 16 | 17 | 18 |
| Inner core hardness (a) | 69 | 69 | 70 |
| Middle core hardness (b) | 47 | 47 | 47 |
| Outer core hardness (c) | 69 | 70 | 69 |

TABLE 10-continued

| Test item | Example No. 16 | 17 | 18 |
|---|---|---|---|
| Difference in hardness (a–b) | 22 | 22 | 23 |
| Difference in hardness (c–b) | 22 | 23 | 22 |
| Inner core diameter (mm) | 20.4 | 20.4 | 20.4 |
| Middle core thickness (mm) | 1.6 | 1.6 | 1.6 |
| Outer core thickness (mm) | 7.4 | 7.4 | 7.4 |
| Position of middle layer from core center | | | |
| Inside $h_1$ (mm) | 10.2 | 10.2 | 10.2 |
| Outer $h_2$ (mm) | 11.8 | 11.8 | 11.8 |
| Core diameter (mm) | 38.4 | 38.4 | 38.4 |
| Cover thickness (mm) | 2.3 | 2.3 | 2.3 |
| (Ball properties) | | | |
| Coefficient of restitution A (35) | 108 | 108 | 108 |
| Coefficient of restitution B (45) | 104 | 104 | 104 |
| A–B | 4 | 4 | 4 |

TABLE 11

| Test item | Comparative Example No. 1 | 2 | 3 | 4 | 5 |
|---|---|---|---|---|---|
| Inner core hardness (a) | 70 | 58 | 82 | 70 | 69 |
| Middle core hardness (b) | 55 | 47 | 39 | 70 | 50 |
| Outer core hardness (c) | 70 | 58 | 82 | 70 | 69 |
| Difference in hardness (a–b) | 15 | 14 | 43 | 0 | 19 |
| Difference in hardness (c–b) | 15 | 14 | 43 | 0 | 19 |
| Inner core diameter (mm) | 20.4 | 20.4 | 20.4 | 20.4 | 20.4 |
| Middle core thickness (mm) | 1.6 | 1.6 | 1.6 | 1.6 | 1.6 |
| Outer core thickness (mm) | 7.4 | 7.4 | 7.4 | 7.4 | 7.4 |
| Position of middle layer from core center | | | | | |
| Inside $h_1$ (mm) | 10.2 | 10.2 | 10.2 | 10.2 | 10.2 |
| Outer $h_2$ (mm) | 11.8 | 11.8 | 11.8 | 11.8 | 11.8 |
| Core diameter (mm) | 38.4 | 38.4 | 38.4 | 38.4 | 38.4 |
| Cover thickness (mm) | 2.3 | 2.3 | 2.3 | 2.3 | 2.3 |
| (Ball properties) | | | | | |
| Coefficient of restitution A (35) | 100 | 96 | 99 | 99 | 102 |
| Coefficient of restitution B (45) | 100 | 97 | 100 | 101 | 101 |
| A–B | 0 | −1 | −1 | −2 | 1 |

As is apparent from the above-mentioned results, in the golf balls of the present invention of Examples 1 through 18, when compared with the golf balls of the Comparative Examples, the coefficient of restitution when hit at low head speed (35 m/sec) is larger than when hit at high head speed (45 m/sec). The golf balls in Examples 16 through 18 differ from the golf ball in Example 4 in that organic sulfide compound is added to the inner core and the outer core, and the rebound characteristics are on the same level. However, when the golf balls in Examples 16 through 18 are compared with the golf ball in Example 4, cost increases by as much organic sulfide compound that is added.

On the other hand, although the requisites of the present invention are satisfied by the golf balls of Comparative Examples 1 and 5 in terms of hardness and distribution of hardness, an organic sulfide compound is not added and therefore, the technical effect of improving the rebound characteristics is not obtained and the coefficient of restitution is small, regardless of head speed. The JIS-C hardness of the inner core and outer core in the core is low in the golf ball of Comparative Example 2, and the ball is too soft, which reduces the rebound characteristics. Therefore, the coefficient of restitution is very small regardless of head speed.

In the golf ball of Comparative Example 3, the difference in hardness between the inner core and middle core and the difference in hardness between the outer core and middle core are too large, and the coefficient of restitution is small. In addition, the coefficient of restitution when hit at low head speed (35 m/sec) is not large. In the golf ball of Comparative Example 4, since all three layers in the core have the same hardness, the technical effect of the present invention accomplished by placing a soft layer between two hard layers is not sufficiently obtained. Therefore, the coefficient of restitution when hit at low head speed (35 m/sec) is not large.

Furthermore, although the amount of organic sulfide compound added over the entire core is the same with the golf balls in Example 4 and Comparative Example 5, the coefficient of restitution is high and the coefficient of restitution when hit at low head speed (35 m/sec) is high in the golf ball of Example 4 wherein the addition of organic sulfide compound was focused on the middle core of low hardness, while the coefficient of restitution is low in the golf ball of Comparative Example 5 wherein the organic sulfide compound was added at a uniform ratio over the entire core, when compared to the golf ball of Example 4.

Furthermore, the difference in the coefficient of restitution A and B (A–B) at each head speed (35 m/sec and 45 m/sec) was calculated and is shown in Tables 7 through 11. When the value of the (A–B) is positive, hitting at 35 m/sec is an advantage as the value becomes larger, and when it is negative, hitting at 45 m/sec is an advantage. That is, when the difference (A–B) is positive, the rebound characteristics do not depend on the head speed as the value becomes larger and the rebound characteristics are not degraded, even when the head speed at the time of hitting is low.

What is claimed is:

1. A multi-piece solid golf ball comprising a core consisting of an inner core, a middle core covering the inner core and an outer core covering the middle core, and at least one layer of cover formed on the core, wherein the inner core has a JIS-C hardness of 63 to 83, the outer core has a JIS-C hardness of 63 to 83, the JIS-C hardness of the inner core is larger than the JIS-C hardness of the middle core by 4 to 40, and the JIS-C hardness of the outer core is larger than the JIS-C hardness of the middle core by 4 to 40 greater;

the inner core and outer core are formed from a vulcanized molded article of a rubber composition comprising base rubber, co-crosslinking agent, organic peroxide, and optionally organic sulfide compound;

the middle core is formed from a vulcanized molded article of a rubber composition comprising base rubber, co-crosslinking agent, organic peroxide, and organic sulfide compound; and the following two formulas are satisfied when the amount of organic sulfide compound that is added to the inner core, middle core and outer core, based on 100 parts by weight of the base rubber is $H_1$, $H_2$, and $H_3$, respectively, in terms of parts by weight:

$$0 \leqq H_1/H_2 < 1$$

$$0 \leqq H_3/H_2 < 1.$$

2. The multi-piece solid golf ball according to claim 1, wherein the $H_1$, $H_2$, and $H_3$ satisfy the following two formulas:

$$0 \leqq H_1/H_2 < 0.75$$

$$0 \leqq H_3/H_2 < 0.75.$$

3. The multi-piece solid golf ball according to claim 1, wherein the $H_2$ is 0.1 to 10.0 and $H_1$ and $H_3$ are 0 to 1.0.

4. The multi-piece solid golf ball according to claim 1, wherein the middle core comprises organic sulfide compound, and the inner core and outer core do not comprise organic sulfide compound.

5. The multi-piece solid golf ball according to claim 1, wherein the middle core has a thickness of 1.0 to 7.0 mm and the middle core is placed at a distance within the range of 6.5 to 20.0 mm from the center point of the core.

6. The multi-piece solid golf ball according to claim 1, wherein the middle core has a JIS-C hardness of 30 to 80.

* * * * *